US012247485B2

(12) United States Patent
Zhang et al.

(10) Patent No.: US 12,247,485 B2
(45) Date of Patent: Mar. 11, 2025

(54) ROTARY STEERABLE SYSTEM WITH MULTIPLE ROWS OF ACTUATORS

(71) Applicant: Halliburton Energy Services, Inc., Houston, TX (US)

(72) Inventors: Lizheng Zhang, Houston, TX (US); Paravastu Badrinarayanan, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/230,949

(22) Filed: Aug. 7, 2023

(65) Prior Publication Data

US 2025/0052117 A1 Feb. 13, 2025

(51) Int. Cl.
*E21B 7/06* (2006.01)

(52) U.S. Cl.
CPC ..... *E21B 7/067* (2013.01)

(58) Field of Classification Search
CPC ..... E21B 7/04; E21B 7/046; E21B 7/06
See application file for complete search history.

(56) References Cited

U.S. PATENT DOCUMENTS

| | | | | |
|---|---|---|---|---|
| 8,672,056 | B2 | 3/2014 | Clark et al. | |
| 9,057,223 | B2 | 6/2015 | Perrin et al. | |
| 10,415,363 | B2 | 9/2019 | Mauldin et al. | |
| 2005/0150692 | A1 | 7/2005 | Ballantyne et al. | |
| 2012/0160563 | A1* | 6/2012 | Clark | E21B 17/1014 175/73 |
| 2016/0060959 | A1* | 3/2016 | Lehr | E21B 7/062 175/74 |
| 2016/0069139 | A1* | 3/2016 | Sugiura | E21B 7/06 175/73 |
| 2020/0332597 | A1 | 10/2020 | Doud et al. | |
| 2020/0332599 | A1 | 10/2020 | Doud et al. | |

OTHER PUBLICATIONS

International Search Report and Written Opinion for International Patent Application No. PCT/US2023/031142 dated Apr. 24, 2024. PDF file. 9 pages.

* cited by examiner

*Primary Examiner* — Caroline N Butcher
(74) *Attorney, Agent, or Firm* — Benjamin Ford; C. Tumey Law Group PLLC

(57) ABSTRACT

A rotary steerable system on a bottom-hole assembly, that includes a first actuator row, that includes a first steering actuator, a second steering actuator, and a third steering actuator, and a second actuator row, disposed at a radial offset from the first actuator row, that includes a fourth steering actuator.

20 Claims, 6 Drawing Sheets

ROTARY STEERABLE SYSTEM WITH MULTIPLE ROWS OF ACTUATORS

BACKGROUND

Boreholes may be created for a variety of purposes, including for use as a fluid conduit to access subterranean deposits. A drilling operation may be utilized to construct one or more boreholes to access those subterranean deposits. During the construction of a borehole, it may be necessary to steer the drill bit along as desired path. Accordingly, one or more components on a drillstring may be used to steer the drill bit when drilling.

BRIEF DESCRIPTION OF DRAWINGS

These drawings illustrate certain aspects of some examples of the present disclosure and should not be used to limit or define the disclosure.

DETAILED DESCRIPTION

Overview and Advantages

Figure 1:
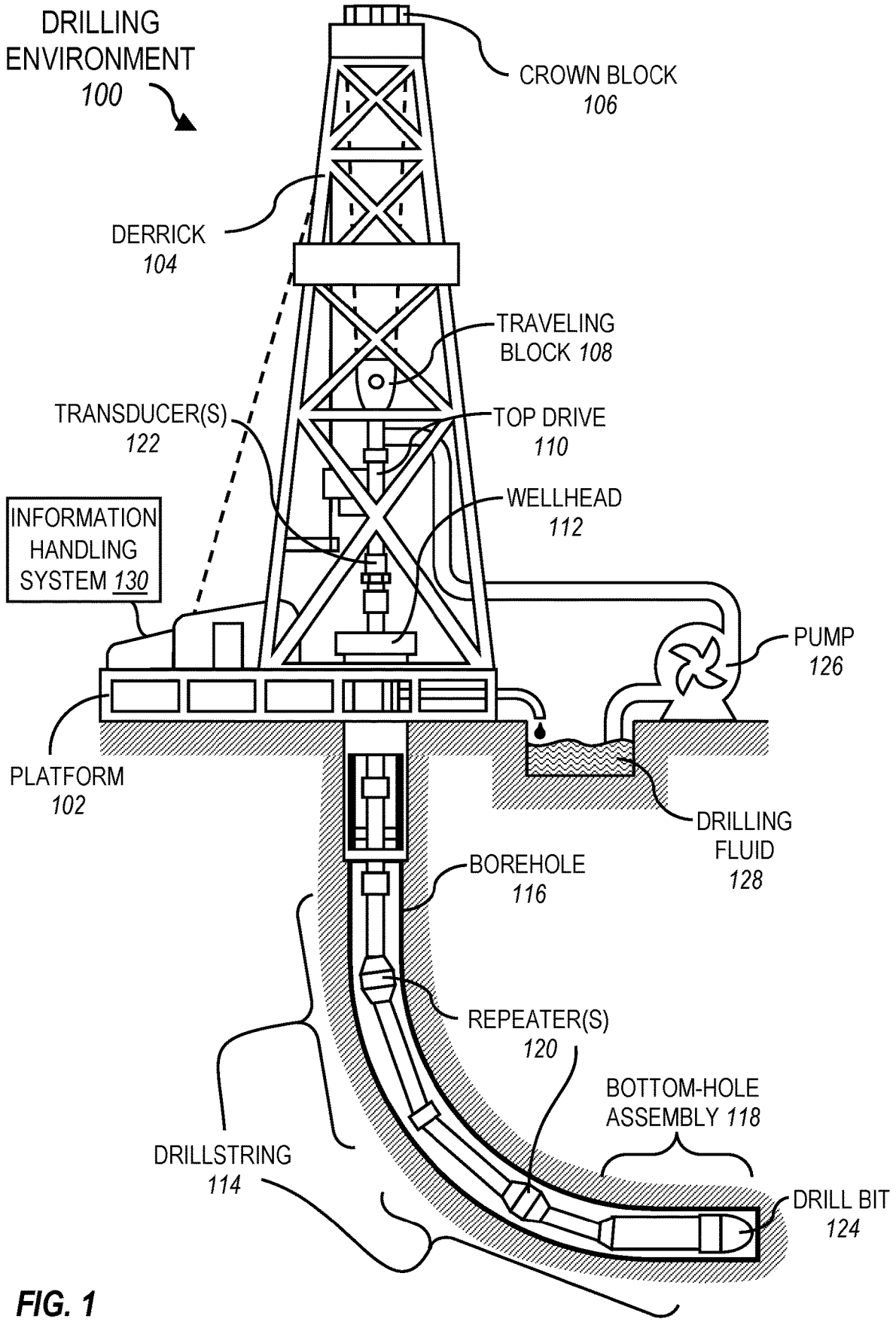
FIG. 1 is a diagram of an example drilling environment.

In general, this application discloses one or more embodiments for providing a rotary steerable system on a drillstring that is capable of more precise steering of a bottom-hole assembly (and a drill bit thereon).

In traditional steerable drilling systems, a "push-the-bit" steering mechanism may be utilized where one or more steering actuator(s) are extended to press against the walls of a borehole, thereby causing the drill bit to be "pushed" in a different direction. In such systems, steering actuators are disposed, in a row, around the circumference of the bottom-hole assembly and are activated (extended) when the steering actuator is in the correct position to push the drill bit in the desired direction. Thus, provided a sufficient number of steering actuators, it is possible to steer the drill bit in a chosen direction.

However, the precision of such a steerable system varies depending on the number of steering actuators disposed around the bottom-hole assembly. As a non-limiting example, a bottom-hole assembly—with three steering actuators disposed circumferentially 120° apart—may only be able to steer the drill bit in a 60° window (e.g., ±30° around the target). That is, the drill bit sweeps back-and-forth over a 60° arc of the borehole wall as the steering actuators extend and retract.

This imprecision is largely due to the lack of sufficient resolution (e.g., density of steering actuators) to steer more narrowly. Continuing with the same example, where there are three steering actuators, those steering actuators can only push the drill bit in the correct direction for a small period when rotating, and it is not possible to sufficiently change direction of the drill bit when the steering actuators are not providing more consistent counterforce. Accordingly, in these traditional systems, the steering actuators are used to push the drill bit for a larger portion of the rotation surrounding the target direction (e.g., ±30°). Thus, when a traditional rotary steerable system is used to change drilling direction, a wider borehole is drilled, it may take more distance to achieve the desired drilling direction, and the bottom-hole assembly experiences inordinate vibration.

One potential solution is to simply add more steering actuators to the existing ring of actuators around the bottom-hole assembly. Yet, as an example, a rotary steerable system with one additional steering actuator (four steering actuators disposed 90° apart circumferentially) would still sweep the drill bit over a 45° arc (+22.5°) when changing direction. Further, as each steering actuator has some minimum width, and the bottom-hole assembly has a limited circumference, there is a physical limit to the number of steering actuators that can be placed around a bottom-hole assembly.

As disclosed in any embodiment herein, a second (and third, fourth, etc.) ring of actuators may be added to provide additional steering actuators on a bottom-hole assembly. As an example, a system that traditionally uses three steering actuators circumferentially disposed 120° around a bottom-hole assembly may include an additional ring of steering actuators, also disposed 120° apart, but at a radial offset from the existing row by 60°. Thus, a steering actuator would be disposed every 60° circumferentially around the bottom-hole assembly, providing twice the density of steering actuators. Such a system would allow for more precise directional drilling, requiring only a 30° arc (±15°) to change direction. Further, there is no limit to the number of actuator rings and to provide additional steering control.

Advantages of such a system are that it allows for the installation of additional steering actuators, even when those steering actuators are too large to be disposed within the same actuator row (i.e., a single ring around the bottom-hole assembly). Further, as the directionality of the drill bit is more tightly constrained, there is less vibration on the bottom-hole assembly, a smoother borehole is drilled, and a higher dogleg severity (change in borehole angle per distance [deg/100 ft]) is achievable.

FIG. 1

FIG. 1 is a diagram of an example drilling environment. Drilling environment 100 may include drilling platform 102 that supports derrick 104 having a traveling block 108 for raising and lowering top drive 110 and drillstring 114. Top drive 110 supports and rotates drillstring 114 as it is lowered through wellhead 112. In turn, drill bit 124, located at the end of drillstring 114, may create borehole 116. Each of these components is described below.

Platform 102 is a structure which may be used to support one or more other components of drilling environment 100 (e.g., derrick 104). Platform 102 may be designed and constructed from suitable materials (e.g., concrete) which are able to withstand the forces applied by other components (e.g., the weight and counterforces experienced by derrick 104). In any embodiment, platform 102 may be constructed to provide a uniform surface for drilling operations in drilling environment 100.

Derrick 104 is a structure which may support, contain, and/or otherwise facilitate the operation of one or more pieces of the drilling equipment. In any embodiment, derrick 104 may support crown block 106, traveling block 108, and/or any part connected to (and including) drillstring 114.

Derrick 104 may be constructed from any suitable materials (e.g., steel) to provide the strength necessary to support those components.

Crown block 106 is one or more simple machine(s) which may be rigidly affixed to derrick 104 and include a set of pulleys (e.g., a "block"), threaded (e.g., "reeved") with a drilling line (e.g., a steel cable), to provide mechanical advantage. Crown block 106 may be disposed vertically above traveling block 108, where traveling block 108 is threaded with the same drilling line.

Traveling block 108 is one or more simple machine(s) which may be movably affixed to derrick 104 and include a set of pulleys, threaded with a drilling line, to provide mechanical advantage. Traveling block 108 may be disposed vertically below crown block 106, where crown block 106 is threaded with the same drilling line. In any embodiment, traveling block 108 may be mechanically coupled to drillstring 114 (e.g., via top drive 110) and allow for drillstring 114 (and/or any component thereof) to be lifted from (and out of) borehole 116. Both crown block 106 and traveling block 108 may use a series of parallel pulleys (e.g., in a "block and tackle" arrangement) to achieve significant mechanical advantage, allowing for the drillstring to handle greater loads (compared to a configuration that uses non-parallel tension). Traveling block 108 may move vertically (e.g., up, down) within derrick 104 via the extension and retraction of the drilling line.

Top drive 110 is a machine which may be configured to rotate drillstring 114. Top drive 110 may be affixed to traveling block 108 and configured to move vertically within derrick 104 (e.g., along with traveling block 108). In any embodiment, the rotation of drillstring 114 (caused by top drive 110) may cause drillstring 114 to form borehole 116. Top drive may use one or more motor(s) and gearing mechanism(s) to cause rotations of drillstring 114. In any embodiment, a rotatory table (not shown) and a "Kelly" drive (not shown) may be used in addition to, or instead of, top drive 110.

Wellhead 112 is a machine which may include one or more pipes, caps, and/or valves to provide pressure control for contents within borehole 116 (e.g., when fluidly connected to a well (not shown)). In any embodiment, during drilling, wellhead 112 may be equipped with a blowout preventer (not shown) to prevent the flow of higher-pressure fluids (in borehole 116) from escaping to the surface in an uncontrolled manner. Wellhead 112 may be equipped with other ports and/or sensors to monitor pressures within borehole 116 and/or otherwise facilitate drilling operations.

Drillstring 114 is a machine which may be used to form borehole 116 and/or gather data from borehole 116 and the surrounding geology. Drillstring 114 may include one or more drillpipe(s), one or more repeater(s) 120, and bottom-hole assembly 118. Drillstring 114 may rotate (e.g., via top drive 110) to form and deepen borehole 116 (e.g., via drill bit 124) and/or via one or more motor(s) attached to drillstring 114.

Borehole 116 is a hole in the ground which may be formed by drillstring 114 (and one or more components thereof). Borehole 116 may be partially or fully lined with casing to protect the surrounding ground from the contents of borehole 116, and conversely, to protect borehole 116 from the surrounding ground.

Bottom-hole assembly 118 is a machine which may be equipped with one or more tools for creating, providing structure, and maintaining borehole 116, as well as one or more tools for measuring the surrounding environment (e.g., measurement while drilling (MWD), logging while drilling (LWD)). In any embodiment, bottom-hole assembly 118 may be disposed at (or near) the end of drillstring 114 (e.g., in the most "downhole" portion of borehole 116).

Non-limiting examples of tools that may be included in bottom-hole assembly 118 include a drill bit (e.g., drill bit 124), casing tools (e.g., a shifting tool), a plugging tool, a mud motor, a drill collar (thick-walled steel pipes that provide weight and rigidity to aid the drilling process), actuators (and pistons attached thereto), a rotary steerable system, and any measurement tool (e.g., sensors, probes, particle generators, etc.).

Further, bottom-hole assembly 118 may include a telemetry sub to maintain a communications link with the surface (e.g., with information handling system 130). Such telemetry communications may be used for (i) transferring tool measurement data from bottom-hole assembly 118 to surface receivers, and/or (ii) receiving commands (from the surface) to bottom-hole assembly 118 (e.g., for use of one or more tool(s) in bottom-hole assembly 118).

Non-limiting examples of techniques for transferring tool measurement data (to the surface) include mud pulse telemetry and through-wall acoustic signaling. For through-wall acoustic signaling, one or more repeater(s) 120 may detect, amplify, and re-transmit signals from bottom-hole assembly 118 to the surface (e.g., to information handling system 130), and conversely, from the surface (e.g., from information handling system 130) to bottom-hole assembly 118.

Repeater 120 is a device which may be used to receive and send signals from one component of drilling environment 100 to another component of drilling environment 100. As a non-limiting example, repeater 120 may be used to receive a signal from a tool on bottom-hole assembly 118 and send that signal to information handling system 130. Two or more repeaters 120 may be used together, in series, such that a signal to/from bottom-hole assembly 118 may be relayed through two or more repeaters 120 before reaching its destination.

Transducer 122 is a device which may be configured to convert non-digital data (e.g., vibrations, other analog data) into a digital form suitable for information handling system 130. As a non-limiting example, one or more transducer(s) 122 may convert signals between mechanical and electrical forms, enabling information handling system 130 to receive the signals from a telemetry sub, on bottom-hole assembly 118, and conversely, transmit a downlink signal to the telemetry sub on bottom-hole assembly 118. In any embodiment, transducer 122 may be located at the surface and/or any part of drillstring 114 (e.g., as part of bottom-hole assembly 118).

Drill bit 124 is a machine which may be used to cut through, scrape, and/or crush (i.e., break apart) materials in the ground (e.g., rocks, dirt, clay, etc.). Drill bit 124 may be disposed at the frontmost point of drillstring 114 and bottom-hole assembly 118. In any embodiment, drill bit 124 may include one or more cutting edges (e.g., hardened metal points, surfaces, blades, protrusions, etc.) to form a geometry which aids in breaking ground materials loose and further crushing that material into smaller sizes. In any embodiment, drill bit 124 may be rotated and forced into (i.e., pushed against) the ground material to cause the cutting, scraping, and crushing action. The rotations of drill bit 124 may be caused by top drive 110 and/or one or more motor(s) located on drillstring 114 (e.g., on bottom-hole assembly 118).

Pump 126 is a machine that may be used to circulate drilling fluid 128 from a reservoir, through a feed pipe, to derrick 104, to the interior of drillstring 114, out through drill bit 124 (through orifices, not shown), back upward through borehole 116 (around drillstring 114), and back into the reservoir. In any embodiment, any suitable pump 126 may be used (e.g., centrifugal, gear, etc.) which is powered by any suitable means (e.g., electricity, combustible fuel, etc.).

Drilling fluid 128 is a liquid which may be pumped through drillstring 114 and borehole 116 to collect drill cuttings, debris, and/or other ground material from the end of borehole 116 (e.g., the volume most recently hollowed by drill bit 124). Further, drilling fluid 128 may provide conductive cooling to drill bit 124 (and/or bottom-hole assembly 118). In any embodiment, drilling fluid 128 may be circulated via pump 126 and filtered to remove unwanted debris.

Information handling system 130 is a computing system which may be operatively connected to drillstring 114 (and/or other various components of the drilling environment). In any embodiment, information handling system 130 may utilize any suitable form of wired and/or wireless communication to send and/or receive data to and/or from other components of drilling environment 100. In any embodiment, information handling system 130 may receive a digital telemetry signal, demodulate the signal, display data (e.g., via a visual output device), and/or store the data. In any embodiment, information handling system 130 may send a signal (with data) to one or more components of drilling environment 100 (e.g., to control one or more tools on bottom-hole assembly 118).

FIG. 2A

Figure 2A:
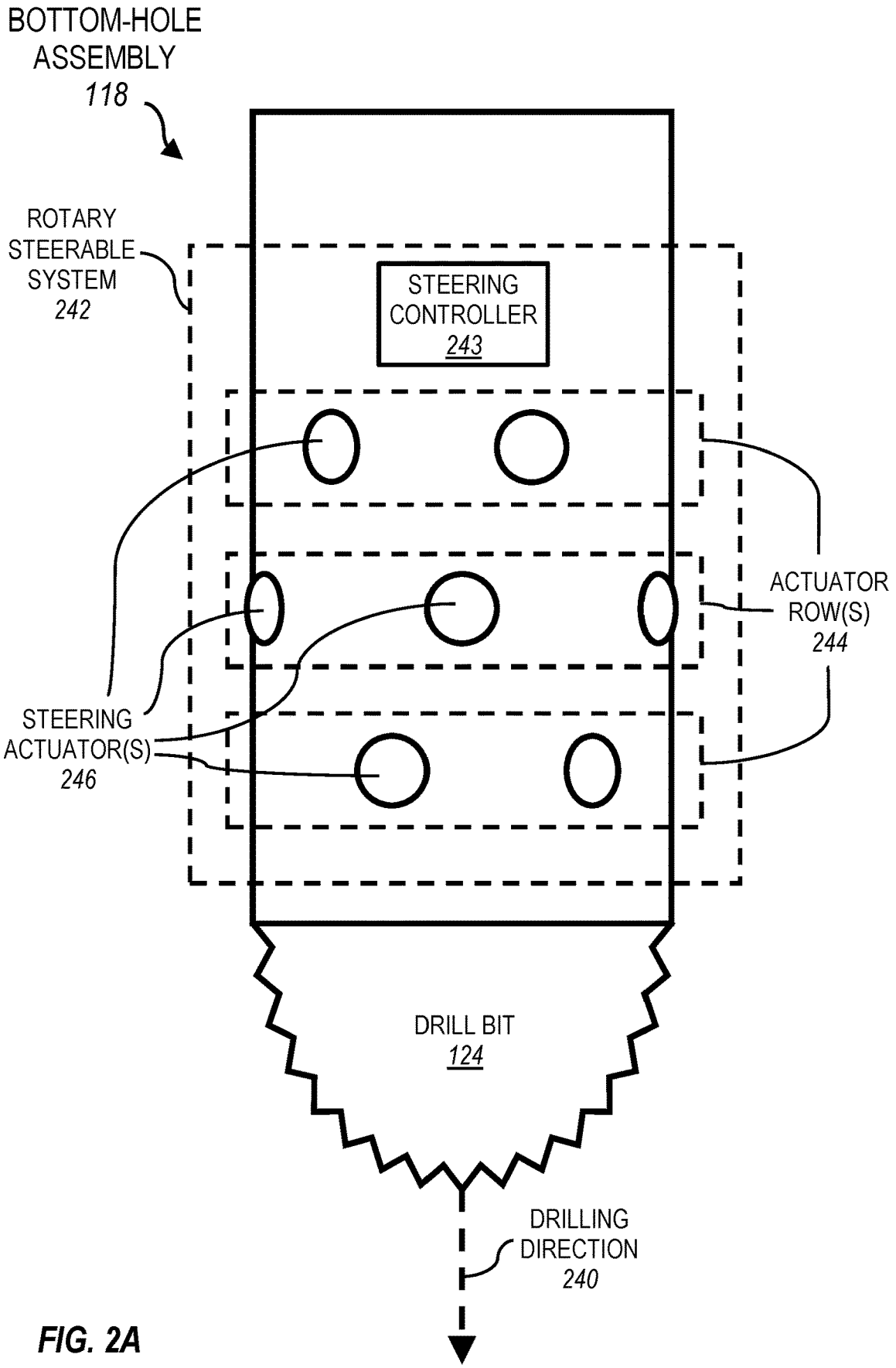
FIG. 2A is a diagram of an example bottom-hole assembly.

FIG. 2A is a diagram of an example bottom-hole assembly. Bottom-hole assembly 118 may include a rotary steerable system 242 to control drilling direction 240 of drill bit 124. Each of these components is described below.

Drilling direction 240 is the direction in which drill bit 124 (and/or bottom-hole assembly 118) is oriented to create borehole 116. Drilling direction 240 may be changed via rotary steerable system 242, using one or more steering actuator(s) 246.

Rotary steerable system 242 is a mechanism which may control drilling direction 240. In any embodiment, rotary steerable system 242 may be coupled to one or more components of drillstring 114 via bottom-hole assembly 118. Rotary steerable system 242 may function by utilizing one or more steering actuator(s) 246 to push against the side(s) of borehole 116 to cause changes in the orientation of drill bit 124 (and/or bottom-hole assembly 118). When steering actuator(s) 246 press against the walls of borehole 116, bottom-hole assembly 118 is subjected to a counteracting force which may cause a torque that pivots drill bit 124 away from an existing drilling direction 240 to a new drilling direction 240 (e.g., a "push-the-bit" system for directional drilling).

In any embodiment, rotary steerable system 242 may function while bottom-hole assembly 118 is rotating. To cause the deflection of drilling direction 240 in a (relatively) consistent direction, steering actuator(s) 246 may be extended only while facing the appropriate direction. That is, as all steering actuator(s) 246 are rotating with bottom-hole assembly 118, steering actuator(s) 246 may be extended only for the portion of time in which they are facing the direction opposite the desired drilling direction 240. Thus, steering actuator(s) 246 may be repeatedly extended and retracted—as bottom-hole assembly 118 rotates—to effectuate the desired change in drilling direction 240.

As a non-limiting example, for simplicity, consider a two-dimensional environment where bottom-hole assembly 118 has a drilling direction 240 due "rightward". Then, to avoid an obstacle, it is desired to have drill bit 124 change to a slightly "downward" (but still mostly rightward) drilling direction 240. To cause this change, steering actuator(s) 246 that face "upward" (i.e., the direction opposite downward) are extended to push drill bit 124 downward. Once the desired drilling direction 240 is achieved, steering actuator(s) 246 remain retracted as no further change in drilling direction 240 is needed.

Steering controller 243 is a mechanism which may control the operation of one or more steering actuator(s) 246 to achieve the desired change in drilling direction 240. Steering controller 243 may be a computing device (e.g., like information handling system 130) which includes a processor, memory, storage, interface device(s), etc. Steering controller 243 may utilize electronic means for controlling steering actuator(s) 246 (e.g., via electrical actuation) and/or via mechanical means for controlling steering actuator(s) 246 (e.g., via hydraulic actuation). Steering controller 243 may control the timing of the extension and retraction of steering actuator(s) 246—as bottom-hole assembly 118 rotates—such that drill bit 124 is deflected to the to the desired drilling direction 240.

Actuator row 244 is an arrangement of two or more steering actuators 246 disposed circumferentially around bottom-hole assembly 118, in a plane that is substantially orthogonal (i.e., perpendicular) to drilling direction 240. As shown in the example of FIG. 2A, steering actuator(s) 246, within one actuator row 244, may be disposed to not align with (i.e., be at a radial offset from) steering actuator(s) 246 in another actuator row 244 (in drilling direction 240). That is, as shown in the example of FIG. 2A, steering actuator(s) 246 are at a radial offset (depicted as horizontal offsets in the two-dimensional example of FIG. 2A) from other steering actuator(s) 246 in the vertical direction (e.g., a vertical line cannot be drawn through two steering actuators 246). In any embodiment, steering actuator(s) 246 in actuator row 244 may be disposed uniformly around a circumference of bottom-hole assembly 118.

As a non-limiting example, as shown in FIG. 2A, a rotary steerable system 242 may include three actuator rows 244. Each actuator row 244 may include five steering actuators 246, for a total of fifteen steering actuators 246 (only seven steering actuators 246 are visible in FIG. 5A). Within a single actuator row 244, the three steering actuators 246 may be disposed 72° apart around the body of bottom-hole assembly 118. Then, the three actuator rows 244 may be arranged in a radial offset of 24° from each other. Thus, steering actuators 246 are disposed every 24° around the body of bottom-hole assembly 118 (e.g., when bottom-hole assembly 118 is viewed head-on, in drilling direction 240). Accordingly, in such an example, finer control of drilling direction 240 may be achieved through use of the distributed steering actuators 246 (e.g., over a 120 (±6°) arc).

FIG. 2B

Figure 2B:
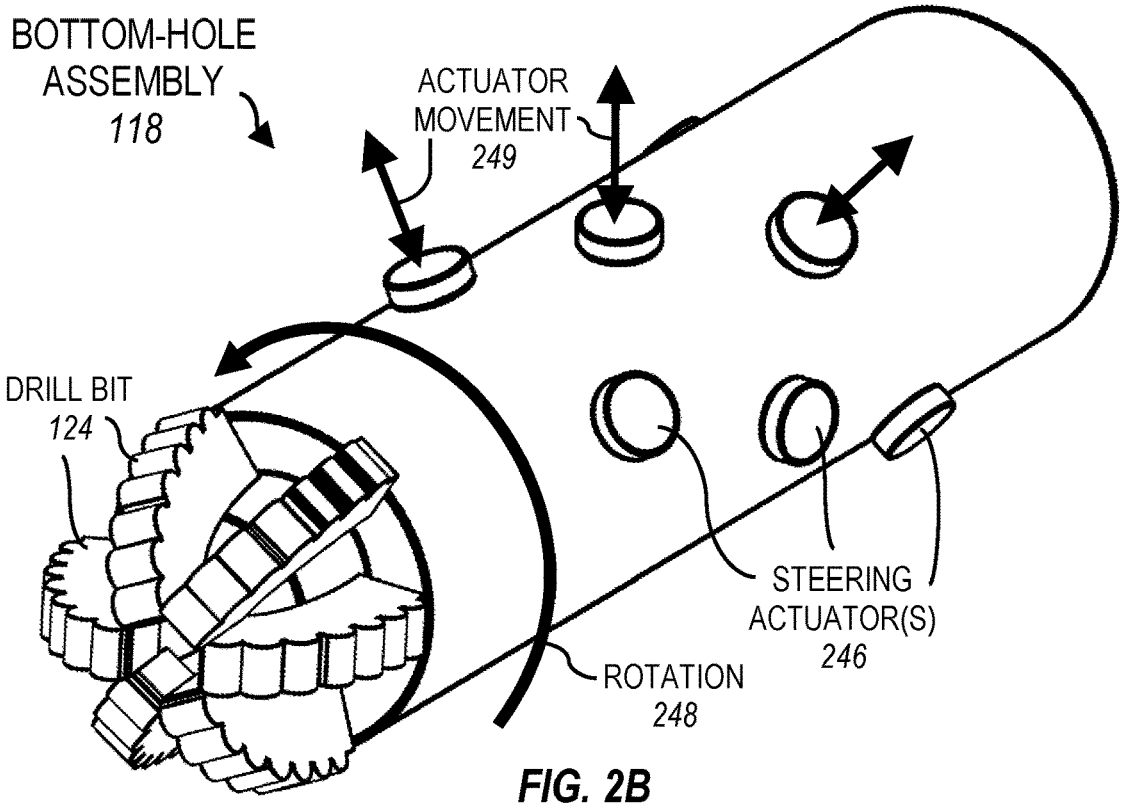
FIG. 2B is a diagram of an example bottom-hole assembly.

FIG. 2B is a diagram of an example bottom-hole assembly. Bottom-hole assembly 118 may include drill bit 124, one or more steering actuator(s) 246, configured for actuator movement 249 during rotation 248.

In the example of FIG. 2B, steering actuator(s) 246 are in the form of pistons which have a linear actuator movement 249 orthogonal to the curved surface of bottom-hole assembly 118. Similar to the example shown in FIG. 2A, in any embodiment, there may be three actuator row(s) 244 with steering actuator(s) 246 disposed at a radial offset from each other around a circumference of bottom-hole assembly 118.

FIG. 2C

Figure 2C:
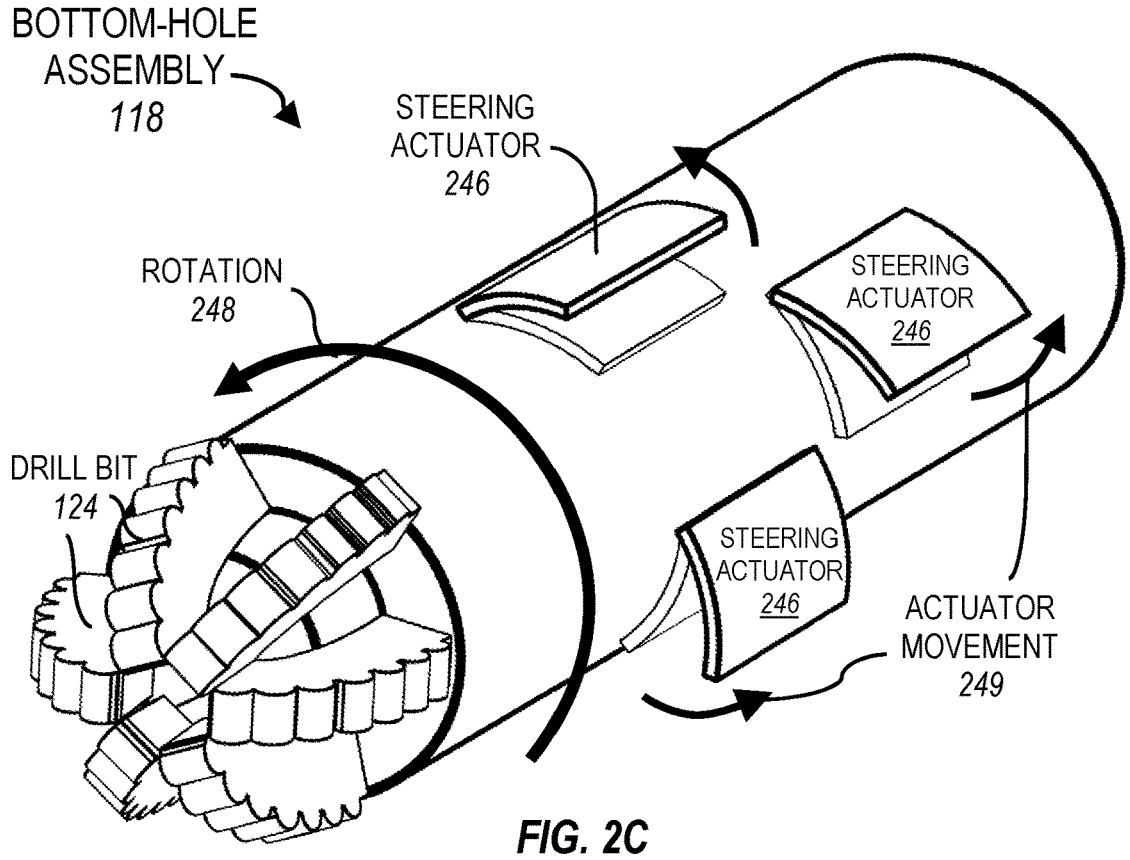
FIG. 2C is a diagram of an example bottom-hole assembly.

FIG. 2C is a diagram of an example bottom-hole assembly. Bottom-hole assembly 118 may include drill bit 124, one or more steering actuator(s) 246, configured for actuator movement 249 during rotation 248.

In the example of FIG. 2C, steering actuator(s) 246 are in the form of hinged pads which have an actuator movement 249 that pivots away from the surface of bottom-hole assembly 118. As shown in the example of FIG. 3C, in any embodiment, there may be two actuator row(s) 244 with steering actuator(s) 246 which are arranged at a radial offset from each other around a circumference of bottom-hole assembly 118.

FIG. 3A

Figure 3A:
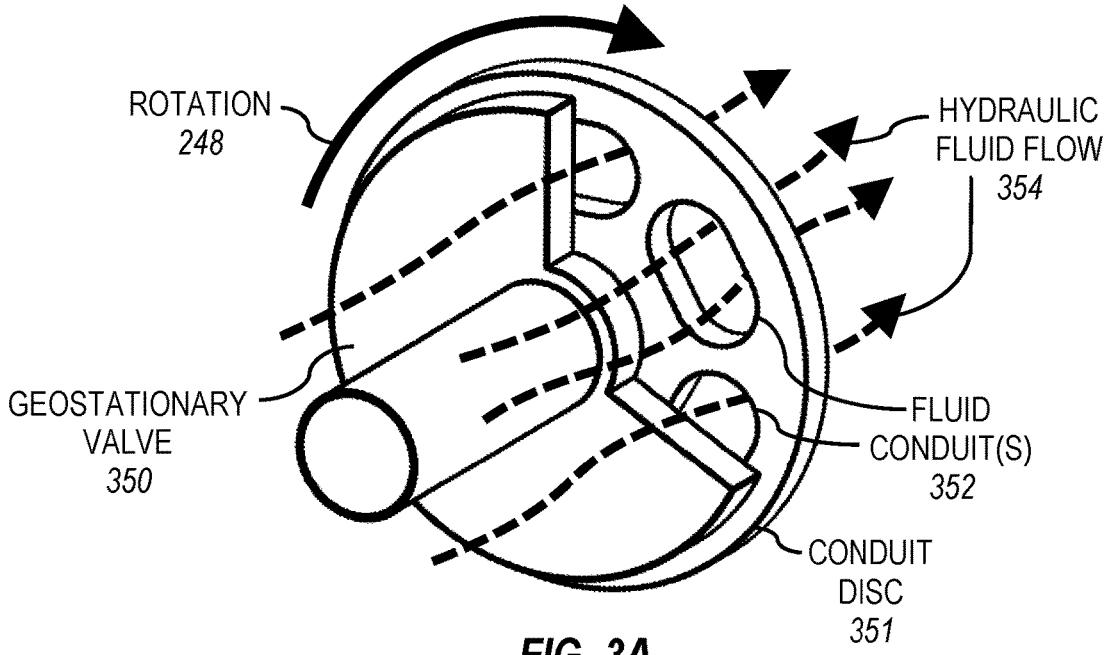
FIG. 3A is a diagram of an example geostationary valve.

FIG. 3A is a diagram of an example geostationary valve. Geostationary valve 350 may be disposed internally in bottom-hole assembly 118 and coupled to conduit disc 351 (with one or more fluid conduit(s) 352) allowing for hydraulic fluid flow 354 to one or more steering actuator(s) 246. Each of these components is described below.

Geostationary valve 350 is a mechanical structure which may control the flow of hydraulic fluid (i.e., hydraulic fluid flow 354) to one or more steering actuator(s) 246. In any embodiment, geostationary valve 350 may not rotate with the other components of bottom-hole assembly 118 (e.g., via rotation 248). Rather, geostationary valve 350 may remain rotationally stationary—but still move with bottom-hole assembly 118 in drilling direction 240. In any embodiment, geostationary valve 350 may be configured (e.g., constructed) and assembled such that, at any given time, one or more fluid conduit(s) 352 are covered (by geostationary valve 350) while one or more fluid conduit(s) 352 are open (not covered by geostationary valve 350).

Figure 3B:
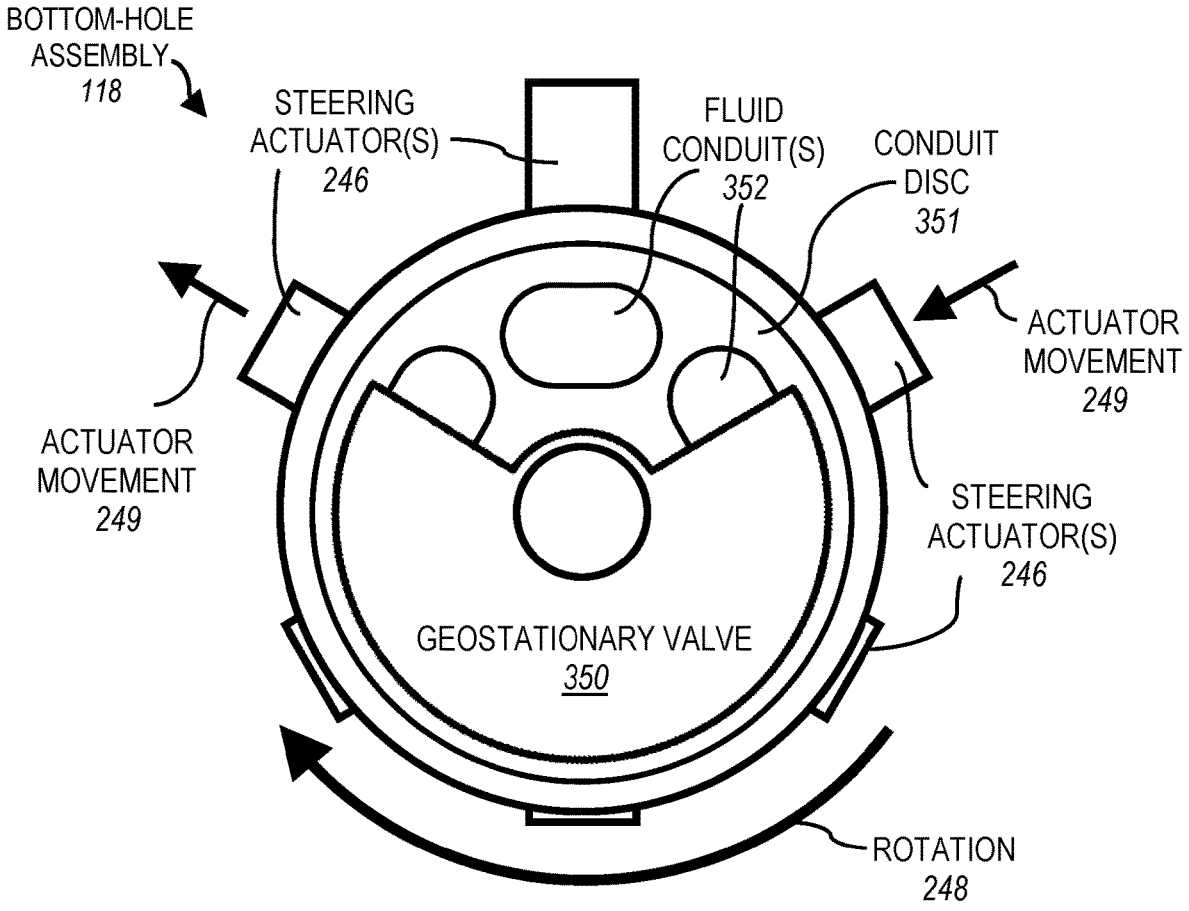
FIG. 3B is a diagram of an example geostationary valve.

As a non-limiting example, as shown in FIG. 3A (and FIG. 3B), there are six fluid conduits 352 disposed 60° circumferentially around conduit disc 351 (only three fluid conduits 352 are visible). Geostationary valve 350 completely covers (at least) three fluid conduits 352 while providing an open "slice" allowing for fluid to flow through (i) the entirety of two fluid conduits 352 (not shown), or (ii) the entirety of one fluid conduit 352 and portions of two other fluid conduits 352 (as shown in FIGS. 3A and 3B).

In any embodiment, geostationary valve 350 may be controllably rotated (independent of rotation 248 of bottom-hole assembly 118). Geostationary valve 350 may be rotated in response to a required change in drilling direction 240, and the placement of where the force is applied to borehole 116. As a non-limiting example, if a more "upward" drilling direction 240 is desired, geostationary valve 350 may be rotated such that the open slice is positioned "downward" to allow steering actuators 246 on the bottoms-side of bottom-hole assembly 118 to receive hydraulic fluid flow 354.

Conduit disc 351 is a mechanical structure which may include one or more fluid conduit(s) 352. In any embodiment, conduit disc 351 provides a structure for including fluid conduit(s) 352 in a geometry that complements geostationary valve 350 (e.g., both are substantially circular) and the steering actuators 246 disposed on bottom-hole assembly.

Fluid conduit 352 is a structure which may provide an opening for hydraulic fluid flow 354. In any embodiment, each fluid conduit 352 may be aligned and affixed to an individual channel (not shown) leading to a single steering actuator 246. That is, each fluid conduit 352 is paired with a steering actuator 246, through which hydraulic fluid flow 354 provides the necessary means to control the movement of the steering actuator 246.

FIG. 3B

FIG. 3B is a diagram of an example geostationary valve. Geostationary valve 350 may be disposed internally in bottom-hole assembly 118 and coupled to conduit disc 351 with one or more fluid conduit(s) 352 allowing for hydraulic fluid flow 354 to one or more steering actuator(s) 246. Each of these components is described below.

As shown in the example of FIG. 3B, as bottom-hole assembly 118 undergoes rotation 248, fluid conduit(s) 352 will either be (i) fully covered by geostationary valve 350, (ii) partially covered by geostationary valve 350 (and partially exposed), or (iii) fully exposed. Fluid conduits 352 are partially or fully exposed during the portion of rotation 248 where geostationary valve 350 does not cover conduit disc 351 (e.g., between 10-o'clock and 2-o'clock as shown in FIG. 3B).

During the portion of rotation 248 when fluid conduit 352 is not covered by geostationary valve 350, hydraulic fluid flow 354 passes through fluid conduit 352 and extends the steering actuator 246 that is paired with fluid conduit 352. In any embodiment, consequently, when geostationary valve 350 covers fluid conduit 352, steering actuator 246 retracts and the fluid is provided a path to escape.

As shown in the example of FIG. 3B, as bottom-hole assembly 118 rotates clockwise, so does conduit disc 351 and the fluid conduit(s) 352 disposed thereon. As fluid conduit 352 moves from being covered behind geostationary valve 350 to being exposed (e.g., the fluid conduit 352 at 10-o'clock), the paired steering actuator 246 (being fully retracted) undergoes actuator movement 249 that extends the steering actuator 246. When fluid conduit 352 is fully exposed, the paired steering actuator 246 is fully extended (e.g., fluid conduit 352 and steering actuator 246 at 12-o'clock) and there is no actuator movement 249. Conversely, as fluid conduit 352 moves from being fully exposed to being covered by geostationary valve 350 (e.g., the fluid conduit 352 at 2-o'clock), the paired steering actuator 246 (being fully extended) undergoes actuator movement 249 that retracts the steering actuator 246.

FIG. 4

Figure 4:
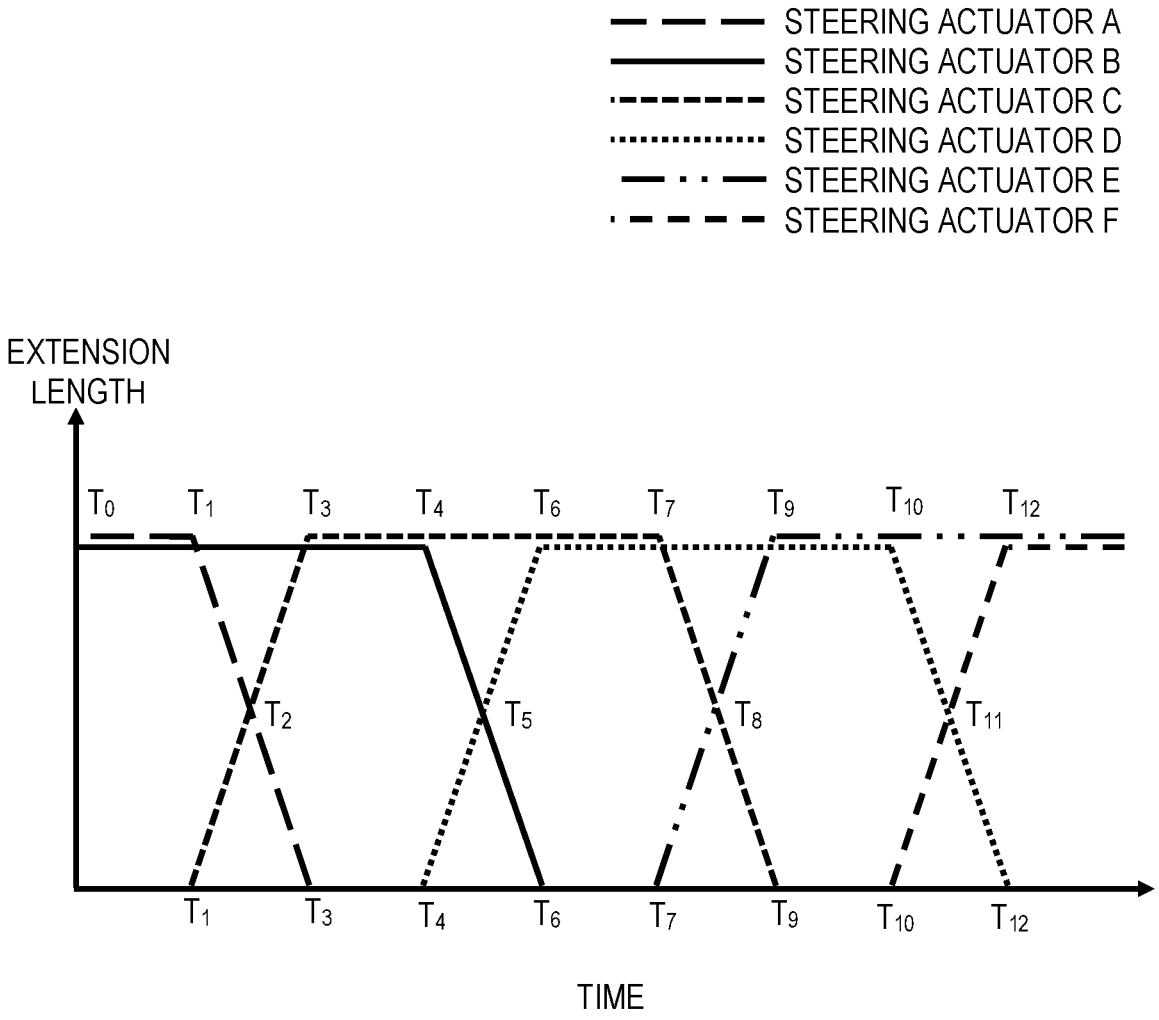
FIG. 4 is a chart showing the extension lengths of example steering actuators.

FIG. 4 is a diagram of a chart showing the extension length of example steering actuators over time. In the example of FIG. 4, there are six steering actuators 246 that are extending and retracting around bottom-hole assembly 118 (similar to the examples depicted in FIGS. 3A-3B). At all times throughout the chart shown in FIG. 4, bottom-hole assembly 118 is rotating and rotary steerable system 242 is actively deflecting drilling direction 240 in a single direction. For visual clarity, the maximum extension height for each steering actuator has been adjusted to avoid overlapping with the neighboring steering actuator. This adjustment should not be interpreted to mean that alternating steering actuators necessarily have different maximum extension lengths.

At $T_0$, steering actuator A and steering actuator B are fully extended. The other four steering actuators are fully retracted.

At $T_1$, steering actuator A and steering actuator B are fully extended. Steering actuator A begins to retract while steering actuator C begins to extend.

At $T_2$, steering actuator A is retracted halfway, steering actuator B is fully extended, and steering actuator C is extended halfway.

At $T_3$, steering actuator B and steering actuator C are fully extended. The other four steering actuators are fully retracted.

At $T_4$, steering actuator B and steering actuator C are fully extended. Steering actuator B begins to retract while steering actuator D begins to extend.

At $T_5$, steering actuator B is retracted halfway, steering actuator C is fully extended, and steering actuator D is extended halfway.

At $T_6$, steering actuator C and steering actuator D are fully extended. The other four steering actuators are fully retracted.

At $T_7$, steering actuator C and steering actuator D are fully extended. Steering actuator C begins to retract while steering actuator E begins to extend.

At $T_8$, steering actuator C is retracted halfway, steering actuator D is fully extended, and steering actuator E is extended halfway.

At $T_9$, steering actuator D and steering actuator E are fully extended. The other four steering actuators are fully retracted.

At $T_{10}$, steering actuator D and steering actuator E are fully extended. Steering actuator D begins to retract while steering actuator F begins to extend.

At $T_{11}$, steering actuator D is retracted halfway, steering actuator E is fully extended, and steering actuator F is extended halfway.

At $T_{12}$, steering actuator E and steering actuator F are fully extended. The other four steering actuators are fully retracted.

As can be seen in the example of FIG. 4, multiple steering actuators 246 may be in various states of actuator movement 249 simultaneously. That is, two or more actuator rows 244 (with steering actuators 246) having a radial offset around bottom-hole assembly 118, allow for the use of multiple steering actuators 246 that are moving independently of each other.

FIG. 5

Figure 5:
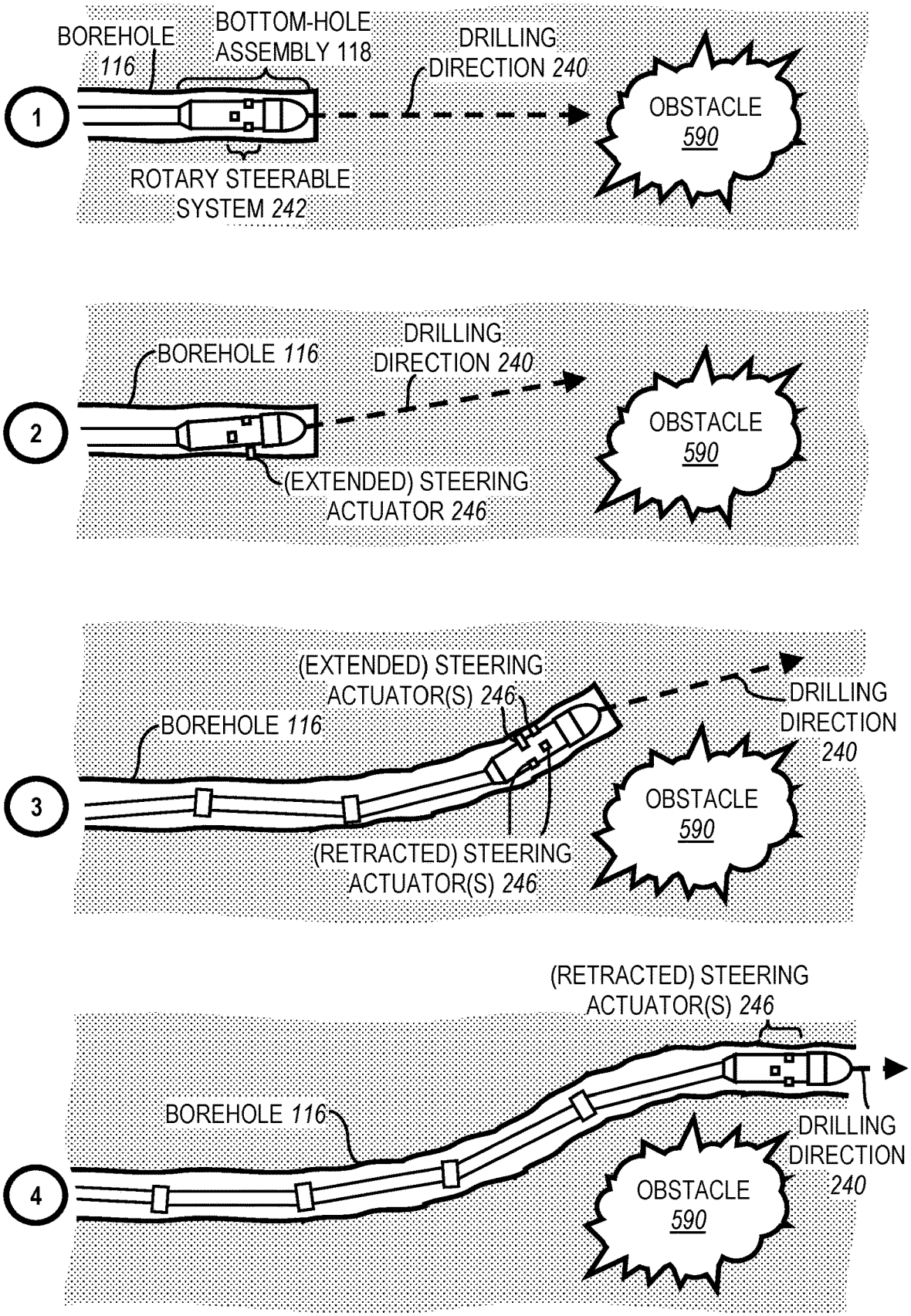
FIG. 5 is a diagram of an example usage of a rotary steerable system.

FIG. 5 is a diagram of an example usage of a rotary steerable system. As shown in the example of FIG. 5, bottom-hole assembly 118 may be drilling, in drilling direction 240, to create borehole 116.

At (1), rotary steerable system 242 of bottom-hole assembly 118 is inactive and not using any steering actuator(s) 246 to change drilling direction 240. However, one or more sensors on bottom-hole assembly 118 (or elsewhere on drillstring 114 (not shown)) identifies that obstacle 590 is in the path of drilling direction 240.

At (2), rotary steerable system 242 (and/or a steering controller 243 thereof (not shown)) begins to steer bottom-hole assembly 118 upward to go over obstacle 590. To accomplish this, steering actuator(s) 246 facing downward are extended to push against the bottom wall of borehole 116. As a result of the downward pushing of (extended) steering actuator 246 into borehole 116, the tip of bottom-hole assembly 118 (e.g., drill bit 124) is pushed upward causing drilling direction 240 to, similarly, point upward. Steering actuator(s) 246, that are not facing downward, are retracted so as not to make contact with the walls of borehole 116.

At (3), some time has elapsed and borehole 116 is extended to begin arcing over obstacle 590. To readjust drilling direction 240 to continue rightward (as was the initial drilling direction 240 at (1)), rotary steerable system 242 (and/or a steering controller 243 thereof (not shown)) begins to steer bottom-hole assembly 118 downward to level-off drilling direction 240. To accomplish this, steering actuator(s) 246 facing upward are extended to push against the upper wall of borehole 116. As a result of the upward pushing of (extended) steering actuator 246 into borehole 116, the tip of bottom-hole assembly 118 (e.g., drill bit 124) is pushed downward causing drilling direction 240 to, similarly, point comparatively downward (due right). Steering actuator(s) 246, that are not facing upward, are retracted so as not to make contact with the walls of borehole 116.

At (4), additional time has passed and bottom-hole assembly 118 has leveled-off drilling direction 240 and is creating borehole 116 due rightward. Contact with obstacle 590 was completely avoided as rotary steerable system 242 navigated bottom-hole assembly 118 using one or more steering actuator(s) 246.

Solutions and Improvements

The methods and systems described above are an improvement over the current technology as the methods and systems described herein provide a second (and third, fourth, etc.) actuator row to provide additional steering actuators on a bottom-hole assembly. As an example, a system may be adapted to use three steering actuators circumferentially disposed 120° around a bottom-hole assembly, in one actuator row, and further include an additional actuator row of steering actuators, also disposed 120° apart, but at a radial offset from the existing row by 60°. Thus, a steering actuator would be disposed every 600 circumferentially around the bottom-hole assembly, providing twice the density of steering actuators. Such a system would allow for more precise directional drilling, requiring only a 30° arc (±15°) to change direction. Further, any number of actuator rows may be added to provide additional steering control.

Advantages of such a system are that it allows for the installation of additional steering actuators, even when those steering actuators are too large to be disposed within the same actuator row (i.e., a single ring around the bottom-hole assembly). Further, as the directionality of the drill bit is more tightly constrained, there is less vibration on the bottom-hole assembly, a smoother borehole is drilled, and a higher dogleg severity (change in borehole angle per distance [deg/100 ft]) is achievable.

Statements

The systems and methods may comprise any of the various features disclosed herein, comprising one or more of the following statements.

Statement 1: A rotary steerable system on a bottom-hole assembly, comprising: a first actuator row, comprising: a first steering actuator; a second steering actuator; and a third steering actuator; and a second actuator row, disposed at a radial offset from the first actuator row, comprising: a fourth steering actuator.

Statement 2: The rotary steerable system of claim 1, wherein the second actuator row further comprises: a fifth steering actuator; and a sixth steering actuator.

Statement 3: The rotary steerable system of claim 2, wherein the rotary steerable system is coupled to a drill bit via the bottom-hole assembly.

Statement 4: The rotary steerable system of claim 3, wherein the drill bit is configured to drill in a drilling direction.

Statement 5: The rotary steerable system of claim 4, wherein the first actuator row is disposed in a first plane orthogonal to the drilling direction.

Statement 6: The rotary steerable system of claim 5, wherein the first steering actuator, the second steering actuator, and the third steering actuator are disposed uniformly on a first circumference of the bottom-hole assembly.

Statement 7: The rotary steerable system of claim 6, wherein the second actuator row is disposed in a second plane orthogonal to the drilling direction.

Statement 8: The rotary steerable system of claim 7, wherein the fourth steering actuator, the fifth steering actuator, and the sixth steering actuator are disposed uniformly on a second circumference of the bottom-hole assembly.

Statement 9: The rotary steerable system of claim 8, wherein due to the radial offset, each steering actuator of the first actuator row is not aligned with any of the steering actuators of the second actuator row, in the drilling direction.

Statement 10: A drillstring comprising a rotary steerable system, wherein the rotary steerable system comprises: a first actuator row comprising a first plurality of steering actuators; and a second actuator row comprising a second plurality of steering actuators, wherein the first actuator row and the second actuator row are disposed at a radial offset.

Statement 11: The drillstring of claim 10, wherein the drillstring is configured to drill in a drilling direction.

Statement 12: The drillstring of claim 11, wherein due to the radial offset, each of the first plurality of steering actuators is not aligned with any of the second plurality of steering actuators, in the drilling direction.

Statement 13: The drillstring of claim 12, wherein each of the first plurality of steering actuators are disposed uniformly on a first circumference of the rotary steerable system.

Statement 14: The drillstring of claim 13, wherein each of the first plurality of steering actuators are disposed uniformly on a second circumference of the rotary steerable system.

Statement 15: The drillstring of claim 14, wherein the first plurality of steering actuators comprises three steering actuators.

Statement 16: The drillstring of claim 15 or 17, wherein the second plurality of steering actuators comprises three steering actuators.

Statement 17: The drillstring of claim 14, wherein the first plurality of steering actuators comprises four steering actuators.

Statement 18: The drillstring of claim 15 or 17, wherein the second plurality of steering actuators comprises four steering actuators.

Statement 19: The drillstring of claim 16 or 18, wherein the first plurality of steering actuators are controlled using a geostationary valve.

Statement 20: The drillstring of claim 16 or 18, wherein the first plurality of steering actuators are controlled using electrical actuation.

General Notes

As it is impracticable to disclose every conceivable embodiment of the technology described herein, the figures, examples, and description provided herein disclose only a limited number of potential embodiments. One of ordinary skill in the art would appreciate that any number of potential variations or modifications may be made to the explicitly disclosed embodiments, and that such alternative embodiments remain within the scope of the broader technology. Accordingly, the scope should be limited only by the attached claims. Further, the compositions and methods are described in terms of "comprising," "containing," or "including" various components or steps, the compositions and methods may also "consist essentially of" or "consist of" the various components and steps. Moreover, the indefinite articles "a" or "an," as used in the claims, are defined herein to mean one or more than one of the elements that it introduces. Certain technical details, known to those of ordinary skill in the art, may be omitted for brevity and to avoid cluttering the description of the novel aspects.

For further brevity, descriptions of similarly named components may be omitted if a description of that similarly named component exists elsewhere in the application. Accordingly, any component described with respect to a specific figure may be equivalent to one or more similarly named components shown or described in any other figure, and each component incorporates the description of every similarly named component provided in the application (unless explicitly noted otherwise). A description of any component is to be interpreted as an optional embodiment which may be implemented in addition to, in conjunction with, or in place of an embodiment of a similarly-named component described for any other figure.

Lexicographical Notes

As used herein, adjective ordinal numbers (e.g., first, second, third, etc.) are used to distinguish between elements and do not create any particular ordering of the elements. As an example, a "first element" is distinct from a "second element", but the "first element" may come after (or before) the "second element" in an ordering of elements. Accordingly, an order of elements exists only if ordered terminology is expressly provided (e.g., "before", "between", "after", etc.) or a type of "order" is expressly provided (e.g., "chronological", "alphabetical", "by size", etc.). Further, use of ordinal numbers does not preclude the existence of other elements. As an example, a "table with a first leg and a second leg" is any table with two or more legs (e.g., two legs, five legs, thirteen legs, etc.). A maximum quantity of elements exists only if express language is used to limit the upper bound (e.g., "two or fewer", "exactly five", "nine to twenty", etc.). Similarly, singular use of an ordinal number does not imply the existence of another element. As an example, a "first threshold" may be the only threshold and therefore does not necessitate the existence of a "second threshold".

As used herein, the word "data" may be used as an "uncountable" singular noun—not as the plural form of the singular noun "datum". Accordingly, throughout the application, "data" is generally paired with a singular verb (e.g., "the data is modified"). However, "data" is not redefined to mean a single bit of digital information. Rather, as used herein, "data" means any one or more bit(s) of digital information that are grouped together (physically or logically). Further, "data" may be used as a plural noun if context provides the existence of multiple "data" (e.g., "the two data are combined").

As used herein, the term "operative connection" (or "operatively connected") means the direct or indirect connection between devices that allows for interaction in some way (e.g., via the exchange of information). For example, the phrase 'operatively connected' may refer to a direct connection (e.g., a direct wired or wireless connection between devices) or an indirect connection (e.g., multiple wired and/or wireless connections between any number of other devices connecting the operatively connected devices).

What is claimed is:

1. A rotary steerable system on a bottom-hole assembly, comprising:
- a first actuator row, comprising:
  - a first steering actuator;
  - a second steering actuator; and
  - a third steering actuator; and
- a second actuator row, comprising:
  - a fourth steering actuator disposed radially between the first steering actuator and the second steering actuator,
- wherein the rotary steerable system is configured to:
  - extend the first steering actuator; and
  - extend the fourth steering actuator while the first steering actuator is at least partially extended.

2. The rotary steerable system of claim 1, wherein the second actuator row further comprises:
- a fifth steering actuator; and
- a sixth steering actuator.

3. The rotary steerable system of claim 2, wherein the rotary steerable system is coupled to a drill bit via the bottom-hole assembly.

4. The rotary steerable system of claim 3, wherein the drill bit is configured to drill in a drilling direction.

5. The rotary steerable system of claim 4, wherein the first actuator row is disposed in a first plane orthogonal to the drilling direction.

6. The rotary steerable system of claim 5, wherein the first steering actuator, the second steering actuator, and the third steering actuator are disposed uniformly on a first circumference of the bottom-hole assembly.

7. The rotary steerable system of claim 6, wherein the second actuator row is disposed in a second plane orthogonal to the drilling direction.

8. The rotary steerable system of claim 7, wherein each steering actuator of the first actuator row is not aligned with any of the steering actuators of the second actuator row, in the drilling direction.

9. The rotary steerable system of claim 1, wherein the fourth steering actuator:
- has a first radial offset of less than 90° from the first steering actuator, and
- has a second radial offset of less than 90° from the second steering actuator.

10. A drillstring comprising a rotary steerable system, wherein the rotary steerable system comprises:
- a first actuator row, comprising:
  - a first steering actuator; and
  - a second steering actuator; and
- a second actuator row, comprising:
  - a third steering actuator has a radial offset of 90° or less from the first steering actuator,
- wherein the rotary steerable system is configured to:
  - extend the first steering actuator; and
  - extend the third steering actuator while the first steering actuator is at least partially extended.

11. The drillstring of claim 10, wherein the drillstring is configured to drill in a drilling direction.

12. The drillstring of claim 11, wherein due to the radial offset, each of the first steering actuator and the second steering actuator are not aligned with the third steering actuator, in the drilling direction.

13. The drillstring of claim 12, wherein each of the first steering actuator and the second steering actuator are disposed uniformly on a first circumference of the rotary steerable system.

14. The drillstring of claim 13, wherein each of the second actuator row comprises a fourth steering actuator, wherein the third steering actuator and the fourth steering actuator are disposed uniformly on a second circumference of the rotary steerable system.

15. The drillstring of claim 12, wherein the first actuator row comprises a fourth steering actuator, wherein the first steering actuator, the second steering actuator, and the fourth steering actuator are disposed uniformly on a first circumference of the rotary steerable system-comprises three steering actuators.

16. The drillstring of claim 12, wherein the second actuator row comprises a fourth steering actuator and a fifth steering actuator, wherein the third steering actuator, the fourth steering actuator, and the fifth steering actuator are disposed uniformly on a second circumference of the rotary steerable system.

17. The drillstring of claim 12, wherein the first actuator row comprises a fourth steering actuator and a fifth steering actuator, wherein the first steering actuator, the second steering actuator, the fourth steering actuator, and the fifth steering actuator are disposed uniformly on a first circumference of the rotary steerable system.

18. The drillstring of claim 12, wherein the second actuator row comprises a fourth steering actuator, a fifth steering actuator, and a sixth steering actuator, wherein the third steering actuator, the fourth steering actuator, the fifth steering actuator, and the sixth steering actuator are disposed uniformly on a second circumference of the rotary steerable system.

19. The drillstring of claim 18, wherein the first steering actuator is controlled using a geostationary valve.

20. The drillstring of claim 18, wherein the first steering actuator is controlled using electrical actuation.

* * * * *